US005766071A

United States Patent [19]

Kirkwood

[11] Patent Number: 5,766,071

[45] Date of Patent: Jun. 16, 1998

[54] VENTURI VENTILATION SYSTEM FOR AN ANGLED TILE ROOF AND METHOD THEREFOR

[76] Inventor: Howard G. Kirkwood, 851 Coral Cottage Dr., Henderson, Nev. 89015

[21] Appl. No.: 729,901

[22] Filed: Oct. 15, 1996

[51] Int. Cl.[6] ..... E04D 13/17

[52] U.S. Cl. ..... 454/185; 52/198; 454/365

[58] Field of Search ..... 454/185, 365; 52/198, 199

[56] References Cited

U.S. PATENT DOCUMENTS

| | | | |
|---|---|---|---|
| 2,852,109 | 9/1958 | Pine | 454/185 X |
| 3,368,473 | 2/1968 | Sohda et al. | 454/185 |
| 4,278,071 | 7/1981 | Brill-Edwards | 454/365 X |

FOREIGN PATENT DOCUMENTS

| | | | |
|---|---|---|---|
| 1195096 | 11/1959 | France | 454/365 |
| 617730 | 1/1927 | Germany | 454/185 |
| 59-109733 | 6/1984 | Japan | 454/185 |
| 311107 | 5/1929 | United Kingdom | 454/365 |

*Primary Examiner*—Harold Joyce

*Attorney, Agent, or Firm*—Jeffrey D. Moy; Allen J. Moss; Harry M. Weiss & Associates, P.C.

[57] ABSTRACT

A venturi-type system for cooling a roof by rapidly moving the hot air beneath roof tiles. The air cooling system is passive, and accelerates the evacuation of hot air from beneath roof tiles by creating a venturi system at the uppermost portion of an angled tile roof.

20 Claims, 3 Drawing Sheets

32
34
20
34
32
28a
34
34
32
28
22
26
23
28
32

20
28
22
26
24

28
23
20
24
28
26
24a
22
28
23

22a
26c
26
30
30
30
30
26a
26b
26b
30
30
30
30
26d
30

VENTURI VENTILATION SYSTEM FOR AN ANGLED TILE ROOF AND METHOD THEREFOR

FIELD OF INVENTION

This invention relates generally to ventilation systems for angled tile roofs and methods therefor and, more specifically, to a venturi-type air ventilation system for accelerating the ventilation of hot air that has accumulated below an angled tile roof.

BACKGROUND OF THE INVENTION

Clay and other types of roof tiles are commonly installed on home and other building roofs. Roof tiles are decorative and also protect the roof from direct exposure to the elements, thus increasing the life of the roof. There is, however, a price associated with the installation of an angled (as contrasted with a flat) tile roof. As the sun shines on these roof tiles, the tiles tend to trap and absorb heat. This causes the temperature under the roof tiles to rise, and, in turn, causes the temperature of the angled roof and consequently under the roof or inside the building to rise. As a result, it is often necessary to provide additional artificial cooling, generally in the form of air conditioning, to compensate for such increased heat inside of the building or home.

Some efforts have been made to address the problem of heat accumulation caused by roof tiles. For example, U.S. Pat. No. 5,326,318 issued to Rotter discloses a roof ridge ventilator for cooling air under the roof exiting an opening at the apex of the roof comprising a horizontal support member having side walls, at least one vent opening and air permeable material displaced therein. A row of ridge tiles is placed over the roof ridge ventilator in Rotter. However, the Rotter system— because of its use of a support member having side walls and ridge tiles— does not permit the free flow of air from beneath the roof tiles out through the ventilation system. Moreover, the Rotter system does not have any structure or mechanism for accelerating the flow of hot air out from beneath the roof tiles. Thus, the Rotter system will be relatively inefficient in ventilating a tile roof. U.S. Pat. No. 5,352,154, issued to Rotter, et al., discloses a ventilation system for metal roofs, which system also lacks any structure or mechanism for accelerating the flow of hot air out from beneath the roof tiles.

Therefore, a need existed for an improved roof exterior surface ventilation system and method for air cooling angled tile-type roofs. The improved ventilation system must provide a venturi-type ventilation apparatus, which apparatus will accelerate the evacuation of hot air from beneath the angled roof tiles. The improved system and method must be relatively easy to construct, and must have no moving parts so as to limit the need for maintenance or repair.

SUMMARY OF THE INVENTION

It is an object of the present invention to provide an improved air cooling system for an angled tile roof and method there for.

It is a further object of the present invention to provide an improved angled tile roof air cooling system and method therefor having a venturi-type ventilation apparatus.

It is still a further object of the present invention to provide a passive, relatively maintenance free air cooling system for an angled tile roof and method therefor.

It is yet a further object of the present invention to provide an air cooling system for an angled tile roof and method therefor having a venturi-type ventilation apparatus and screens for preventing undesired objects from entering into the area below the roof tiles.

BRIEF DESCRIPTION OF THE PREFERRED EMBODIMENTS

In accordance with one embodiment of the present invention, an air cooling system for a tile roof is disclosed. The air cooling system comprises, in combination: a first plurality of roof tiles having a plurality of substantially semicircular-shaped tile members located on at least one side of an angled roof wherein each one of the first plurality of roof tiles has an upper exposed end and a lower exposed end; a second plurality of roof tiles having a plurality of substantially semicircular-shaped tile members located on another side of the angled roof wherein each one of the second plurality of roof tiles has an upper exposed end and a lower exposed end; and venturi air ventilation means having a closed top portion, a closed bottom portion and located at a confluence of and in communication with the upper exposed ends of the first plurality and the second plurality of roof tiles for accelerating ventilation of hot air located only above the roof and below the first plurality and the second plurality of roof tiles.

In accordance with another embodiment of the present invention, a method for air cooling a tile roof is disclosed. The method comprises the steps of: providing a first plurality of roof tiles having a plurality of substantially semicircular-shaped tile members located on at least one side of an angled roof wherein each one of the first plurality of roof tiles has an upper exposed end and a lower exposed end; providing a second plurality of roof tiles having a plurality of substantially semicircular-shaped tile members located on another side of the angled roof wherein each one of the second plurality of roof tiles has an upper exposed end and a lower exposed end; and providing venturi air ventilation means located at a confluence of and in communication with the upper exposed ends of the first plurality and the second plurality of roof tiles for accelerating ventilation of hot air located only above the roof and below the first plurality and the second plurality of roof tiles.

The foregoing and other objects, features, and advantages of the invention will be apparent from the following, more particular, description of the preferred embodiments of the invention, as illustrated in the accompanying drawings.

DETAILED DESCRIPTION OF THE PREFERRED EMBODIMENTS

Figure 1:
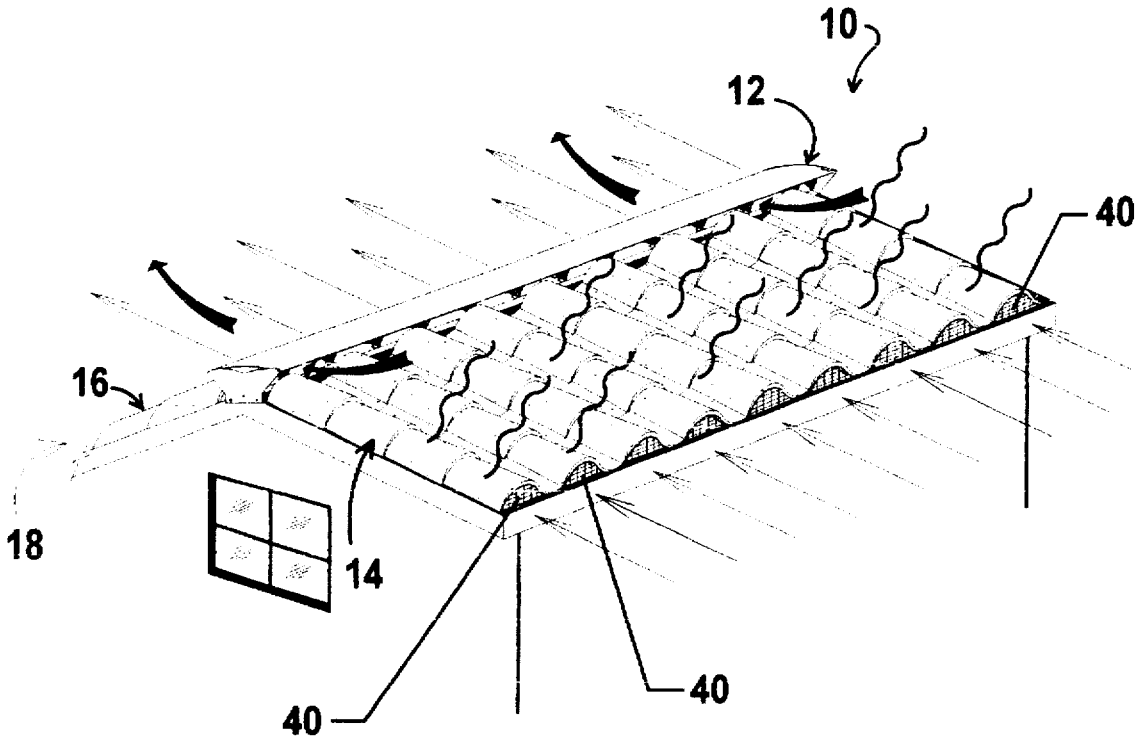
FIG. 1 is a perspective view of the air cooling system for a tile roof of the present invention, as installed on an angled roof.

Referring to FIG. 1, reference number 10 refers generally to the air ventilation system of the present invention. The air ventilation system 10 includes the venturi air ventilation apparatus which is generally referred to by the reference number 12. A first plurality of roof tiles 14 are located on one side and a second plurality of roof tiles 16 are located on the other side of an angled roof 18 from the first plurality of roof tiles 14. As shown in FIG. 1, the Venturi apparatus 12 is located above the roof 18 at the confluence of the first plurality of roof tiles 14 and the second plurality of roof tiles 16.

Figure 2:
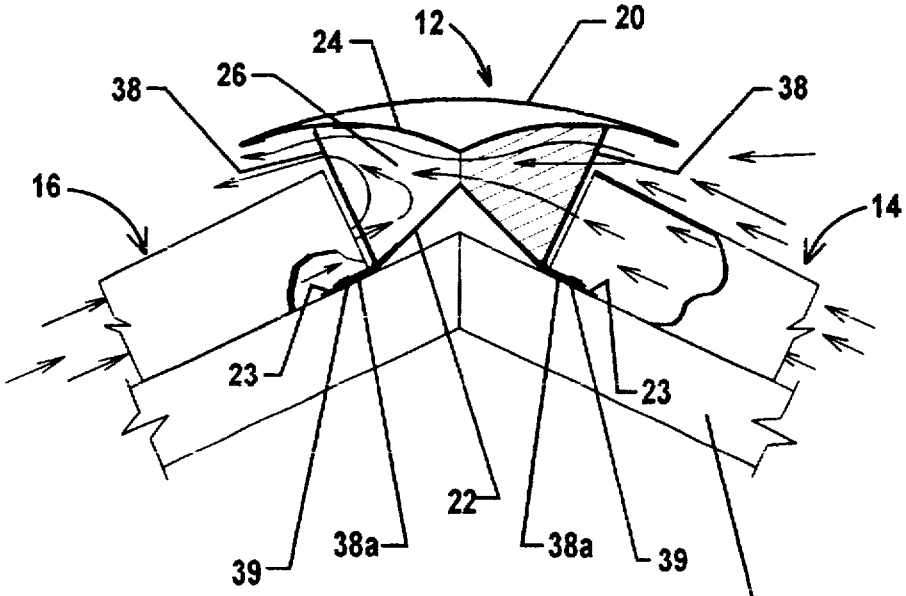
FIG. 2 is a partially cut-away side elevational view of the venturi air ventilation apparatus of the present invention, shown in combination with roof tiles located on an angled roof.
Figure 2B:
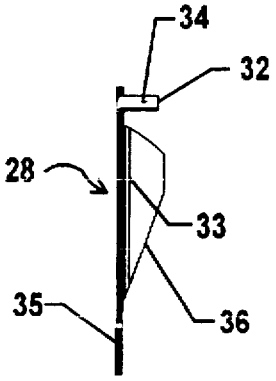
FIG. 2*b* is a right side elevational view of the end cap arrangement depicted in FIG. 2*a* showing a substantially triangular shaped end portion.
Figure 2A:
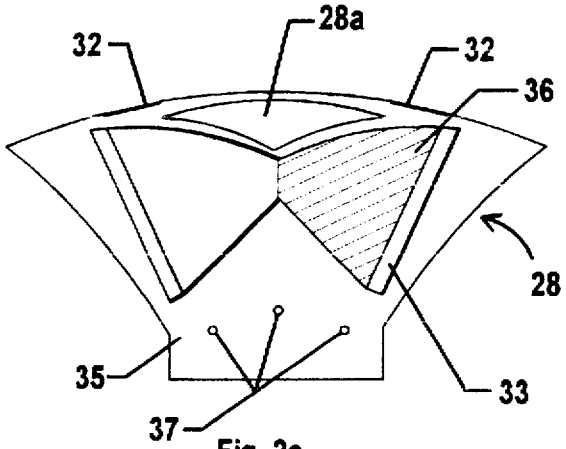
FIG. 2*a* is a side elevational view showing an end cap for the venturi air ventilation apparatus of the present invention.
Figure 2C:
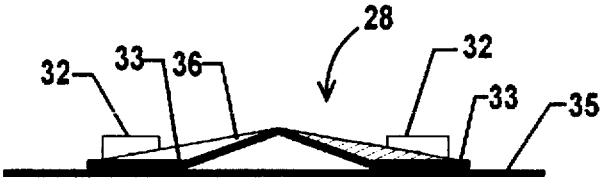
FIG. 2*c* is a bottom view of the end cap of FIG. 2*a*.
Figures 3, 3A, 3B, 3C, 3D:
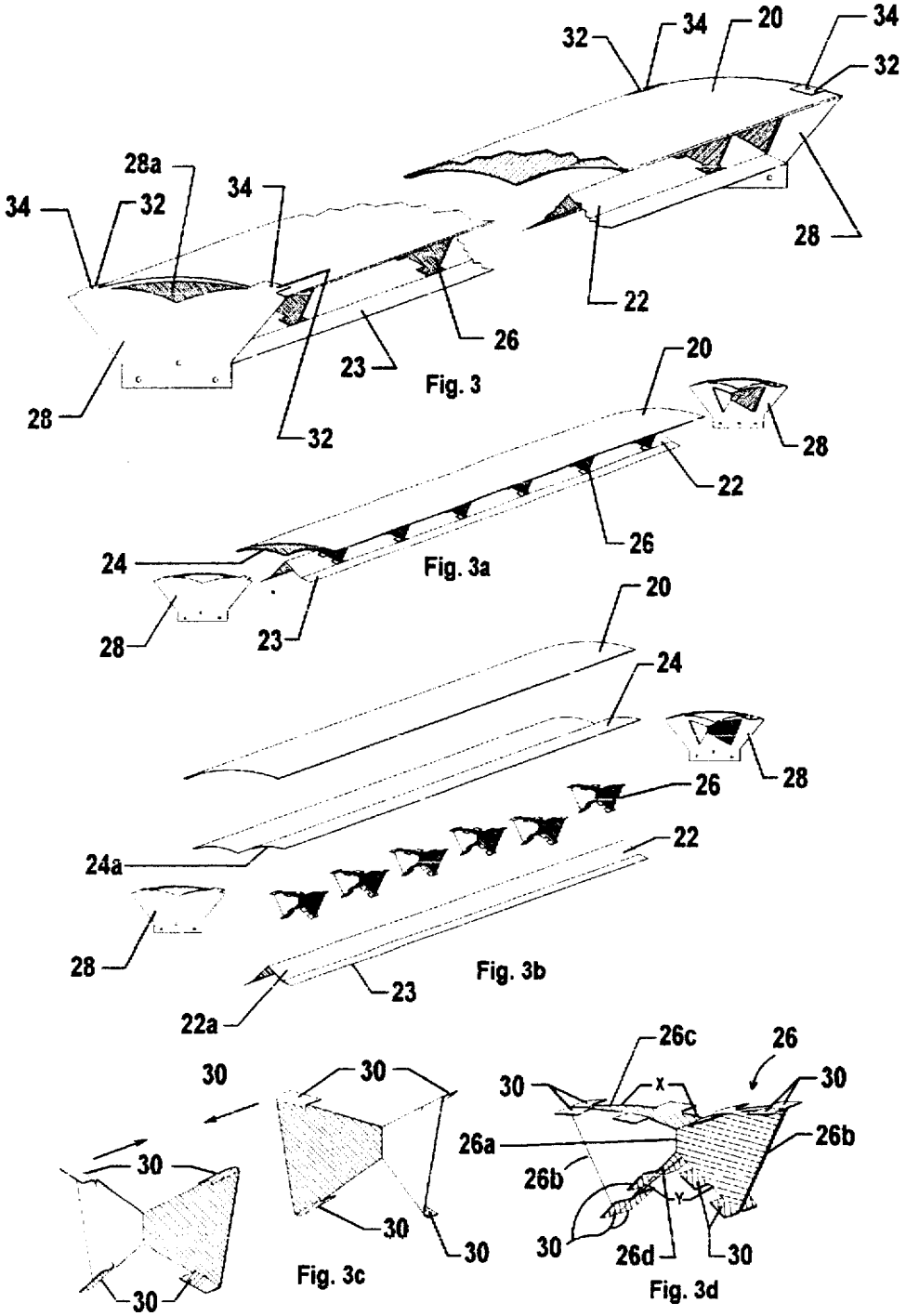
FIG. 3 is a partially cut-away enlarged perspective view of the venturi air ventilation apparatus of the present invention as shown in FIG. 1.
FIG. 3*a* is a partially exploded perspective view (with end caps removed) of the venturi air ventilation apparatus of the present invention as shown in FIGS. 1 and 3.
FIG. 3*b* is an exploded perspective view of the venturi air ventilation apparatus of the present invention as shown in FIGS. 1, 3 and 3*a*.
FIG. 3*c* is an exploded perspective view of how one of the support members is assembled by joining together two members.
FIG. 3*d* is an enlarged perspective view of one of the support members of the air ventilation apparatus of the present invention as shown in FIGS. 3, 3*a* and 3*b*.

Referring now to FIGS. 2 and 3–3*d*, the venturi apparatus 12 comprises a substantially umbrella-shaped upper shield 20 which is preferably made of a sturdy rugged material such as metal, a substantially triangularly-shaped base mounting plate 22, dual concave upper support plate 24, a plurality of support members 26, and opposing end caps 28— each of which elements is preferably manufactured from galvanized steel or other suitable weather resistant material. The base mounting plate 22 is preferably triangular shaped. Preferably, the internal apex angle formed by the base mounting plate 22 is approximately 94 degrees. The base mounting plate 22 features on both sides skirt portions 23 (see FIGS. 3, 3*a* and 3*b*) which are secured to the roof 18 and upon which is placed an uppermost portion of the rows of the plurality of roof tiles 14 and 16. Referring to FIG. 3*d* and 3*c*, each support member 26 is substantially batwing-shaped, and has a plurality of tabs 30 extending laterally therefrom from both a top and bottom portion thereof, for fastening each support member 26 to the base mounting plate 22 and the upper support plate as shown in FIGS. 3 and 3*b*. Once installed in this fashion, the support members 26 are substantially perpendicular to the longitudinal axis of the base mounting plate 22 and the upper support plate 24. Center reduced portion 26*a*(preferebly about one inch in height)of each support member 26 is located at substantially the corresponding center portion of both the base mounting plate 22 and the upper support plate 24. Each support member 26 gradually widens from its outer vertical edges 26*b* to its narrowest or reduced portion 26*a*. An upper edge 26*c* of each support member 26 conforms to the shape of a bottom portion 24*a* (see FIG. 3*b*) of the upper support plate 24, while a bottom edge 26*d* of each support member 26 preferably conforms to the shape of an upper portion 22*a* (see FIG. 3*b*) of the base mounting plate 22.

Referring specifically to FIG. 3*d* or 3*c*, the angle X formed at the top of each support member 26 has a radius of about 9.5 inches. The angle Y formed at the bottom of each support member 26 is preferably approximately 94 degrees.

Referring to FIGS. 3–3*b*, when the support members 26 are installed between the base mounting plate 22 and the upper support plate 24, upper and lower longitudinal air ventilation passageways are formed. The area of each opening formed between the support members 26 by the heights of the outer edges 26*b* of each of the support members 26, the portion of the base mounting plate 22 between each pair of the support members 26, and the portion of the upper support plate 24 between each pair of the support members 26 is preferably approximately 5.6 times the size of the opening formed by the narrowest portions 26*a* of each of the support members 26, the portion of the base mounting plate 22 that is perpendicular to the narrowest portions 26*a*, and the portion of the upper support plate 24 that is perpendicular to the narrowest portions 26*a* .

Referring specifically to FIGS. 2*a–c* and 3–3*b*, there are two end caps 28 that are affixed (after complete assembly and installation by attachment to the shield 20) to the top of the roof 18. Each end cap 28 features tabs 32 extending laterally from an upper portion thereof for securing each of the end caps 28 to the shield 20. Flattened flange portions 33 serve to permit attachment to the back of plate 35 of the end cap 28. The tabs 32 are connected to the top of the plate 35 and these tabs 32 are attached to the top surface of the shield 20 as shown in FIG. 3. A triangular shaped opening 28*a* is located in the upper portion of the plate 35 for ventilation between shield 20 and support plate 24. At least one hole 34 is located in each tab 32 to permit each tab 32 to be secured to the shield 20 with a bolt (not shown) or other fastening means. A triangular shaped member 36 is attached to the back of each plate 35 of the end cap 28 (see FIG. 2*c*). An upper opening 28*a* extends longitudinally through each end cap 32 and screws 37 are used to attach each end cap 28 to a top end portion of the roof 18.

Referring now more specifically to FIG. 2, a screen barrier 38 is secured over the large openings formed on either side of each substantially hourglass-shaped channel bounded by each pair of support members 26 and the portions of the base mounting plate 22 and the upper support plate 24 therebetween. The purpose of the screen barriers 38, which preferably are made of a mesh type wire screen, is to prevent undesired objects like leaves, branches, birds or insects from entering into and clogging the substantially hourglass-shaped channel, while at the same time permitting air to flow substantially unimpeded through each screen barrier 38 from the upper ends of the roof tiles 14 and 16. Each screen barrier 38 is preferably substantially L-shaped, with lower tab-type portions 38*a* that extend outward from the substantially hourglass shaped channel and on the top surface or each of the skirt portions 23 fastened to the roof 18. The lower tab-type portions 38*a* may be fastened to the roof 18 with bolts or nails 39.

Referring again to FIG. 1, a plurality of screen barriers 40 are placed over the openings at the lower portions of each of the plurality of roof tiles 14 and 16 (not shown for the roof tiles 16). The purpose of the screen barriers 40, which preferably are made of a mesh type wire screens is to prevent undesired objects like leaves, branches, birds or insects from entering under the plurality of roof tiles 14 or 16 and restricting the flow of air thereunder, while permitting air to flow substantially unimpeded through the screen barriers 40.

Statement of Operation

The air cooling system of the present invention is constructed in the manner best shown in FIGS. 1, 2, and 3–3*c*. As shown in FIG. 2, each of the open ends of the uppermost tiles of the plurality of roof tiles 14 and 16 are brought into close proximity with the screen-covered opening of the substantially hourglass-shaped channels. As best shown in FIGS. 1 and 2, the arrangement of the placement of the venturi apparatus 12 (which has a configuration of an elongated substantially hourglass-shaped member), the openings of which are larger than the open ends of the uppermost tiles of the plurality of roof tiles 14 and 16, in close proximity with the open ends of those tiles creates a venturi effect. Thus, as the heat of the sun strikes the plurality of roof tiles 14 and 16, the air under those tiles becomes heated and rises (taking advantage that hot air rises) toward the topmost portion of the roof. As the hot air moves upward, cooler external air is pulled into the lowermost open ends of the plurality of roof tiles 14 and 16. Air flowing over the top of the tiles (as shown in FIG. 2) is also channeled through the substantially hourglass-shaped channels, creating lower pressure at the uppermost open ends of the plurality of roof tiles114 and 16. This low pressure acts as a vacuum, pulling in an accelerated fashion the hot air from under both the plurality of roof tiles 14 and the plurality of roof tiles 16 toward the higher located venturi apparatus 12. The accelerated hot air then exits the venturi apparatus 12 in the direction of wind flow, as shown in FIGS. 1 and 2. It is estimated that the air ventilation system of the present invention can lower the temperature under the roof tiles by as much as about 10 to 15 degrees Fahrenheit which provides a significant improvement in cooling the root 18 and the house or building covered by the roof 18.

While the invention has been particularly shown and described with reference to preferred embodiments thereof, it will be understood by those skilled in the art that the foregoing and other changes in form and details may be made therein without departing from the spirit and scope of the invention.

I claim:

1. An air cooling system for a tile roof comprising, in combination:

a first plurality of roof tiles having a plurality of substantially semicircular-shaped tile members located on at least one side of an angled roof wherein each one of said first plurality of roof tiles has an upper exposed end and a lower exposed end;

a second plurality of roof tiles having a plurality of substantially semicircular-shaped tile members located on another side of said angled roof wherein each one of said second plurality of roof tiles has an upper exposed end and a lower exposed end; and venturi air ventilation means having a top portion, a closed bottom having side opeinings larger than the upper exposed ends of siad first and said second plurality of roof tiles which side openings are communication with said upper exposed ends of said first plurality and said second plurality of roof tiles for accelerating ventilation of hot air located only above said roof and below said first plurality and said second plurality of roof tiles.

2. The air cooling system of claim 1 wherein said venturi air ventilation means comprises:

an elongated substantially hourglass-shaped member having a pair of large openings and a narrowed center portion;

one of said pair of large openings being located at one end of said substantially hourglass-shaped member and in communication with each said upper exposed end of each one of said first plurality of roof tiles;

said one of said pair of large openings being larger than each said upper exposed end of each one of said first plurality of roof tiles;

the other of said pair of large openings being located at a second end of said substantially hourglass-shaped member and in communication with each said upper exposed end of each one of said second plurality of roof tiles; and said other of said pair of large openings being larger than each said upper exposed end of each one of said second plurality of roof tiles.

3. The air cooling system of claim 1 wherein a substantially umbrella-shaped shield member is said closed top portion of a top portion of said venturi air ventilation means, said shield member being substantially higher than each upper exposed end of each one of said first plurality and said second plurality of roof tiles.

4. The air cooling system of claim 1 wherein screen means substantially cover all lower exposed ends of said first plurality and said second plurality of roof tiles for preventing undesired objects from passing through said lower exposed ends.

5. The air cooling system of claim 4 wherein said screen means comprises a mesh-type wire screen.

6. The air cooling system of claim 2 wherein screen means substantially cover each of said pair of large openings on said elongated substantially hourglass-shaped member for preventing relatively large objects from passing through said large openings.

7. The air cooling system of claim 6 wherein said screen means comprises a mesh-type wire screen.

8. The air cooling system of claim 2 wherein each of said pair of large openings in said substantially hourglass-shaped member is approximately greater than eight inches in diameter.

9. The air cooling system of claim 2 wherein said narrowed center portion of said substantially hourglass-shaped member is approximately greater than one inch.

10. The air cooling system of claim 2 further comprising:

screen means substantially covering all lower exposed ends of said first plurality and said second plurality of roof tiles for preventing undesired objects from passing through said lower exposed ends; and screen means substantially covering each of said pair of large openings on said elongated substantially hourglass-shaped member for preventing relatively large objects from passing through said large openings.

11. A method for air cooling a tile roof comprising the steps of:

providing a first plurality of roof tiles having a plurality of substantially semicircular-shaped tile members located on at least one side of an angled roof wherein each one of said first plurality of roof tiles has an upper exposed and and a lower exposed end;

providing a second plurality of roof tiles having a plurality of substantially semicircular-shaped tile members located on another side of said angled roof wherein each one of said second plurality of roof tiles has an upper exposed end and a lower exposed end; and providing venturi air ventilation means having a closed top having side ipenings larger trhan the upper exposed ends of said first and said secod plurality of roof tiles which side openings are in communication with said upper exposed ends of said first plurality and said second plurality of roof tiles for accelerating ventilation of hot air located only above said roof and below said first plurality and said second plurality of roof tiles.

12. The method of claim 11 wherein said step of providing venturi air ventilation means further comprises the steps of:

providing an elongated substantially hourglass-shaped member having a pair of large openings and a narrowed center portion;

locating one of said pair of large openings at one end of said substantially hourglass-shaped member and in communication with each said upper exposed end of each one of said first plurality of roof tiles;

said one or said pair of large openings being larger than each said upper exposed end of each one of said first plurality of roof tiles;

locating the other of said pair of large openings at a second end of said substantially hourglass-shaped member and in communication with each said upper exposed end of each one of said second plurality of roof tiles; and said other of said pair of large openings being larger than each said upper exposed end of each one of said second plurality of roof tiles.

13. The method of claim 11 further comprising the step of providing a substantially umbrella-shaped shield member on a top portion of said venturi air ventilation means, said shield member being substantially higher than each upper exposed end of each one of said first plurality and said second plurality of roof tiles.

14. The method of claim 11 further comprising the step of providing screen means substantially covering all lower exposed ends of said first plurality and said second plurality of roof tiles for preventing undesired objects from passing through said lower exposed ends.

15. The method of claim 14 wherein said screen means comprises a mesh-type wire screen.

16. The method of claim 11 further comprising the step of providing screen means substantially covering each of said pair of large openings on said elongated substantially hourglass-shaped member for preventing relatively large objects from passing through said large openings.

17. The method of claim 16 wherein said screen means comprises a mesh-type wire screen.

18. The method of claim 12 wherein each of said pair of large openings in said substantially hourglass-shaped member is approximately greater than eight inches in diameter.

19. The method of claim 12 wherein said narrowed center portion of said substantially hourglass-shaped member is approximately greater than one inch.

20. The method of claim 11 further comprising the steps of:

providing screen means substantially covering all lower exposed ends of said first plurality and said second plurality of roof tiles for preventing undesired objects from passing through said lower exposed ends; and providing screen means substantially covering each of said pair of large openings on said elongated substantially hourglass-shaped member for preventing relatively large objects from passing through said large openings.

* * * * *